US010440782B2

(12) United States Patent
Kobos et al.

(10) Patent No.: US 10,440,782 B2
(45) Date of Patent: Oct. 8, 2019

(54) WINDOW ASSEMBLY FOR AN APPLIANCE PANEL INCORPORATING A GLAZING MEMBER HAVING A CONDUCTIVE/RESISTIVE COATING

(71) Applicant: WHIRLPOOL CORPORATION, Benton Harbor, MI (US)

(72) Inventors: Duane M. Kobos, Laporte, IN (US); Michael T. Moore, Paw Paw, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 761 days.

(21) Appl. No.: 14/976,432

(22) Filed: Dec. 21, 2015

(65) Prior Publication Data

US 2017/0176095 A1 Jun. 22, 2017

(51) Int. Cl.

| | |
|---|---|
| ***H05B 3/84*** | (2006.01) |
| ***F25D 21/04*** | (2006.01) |
| ***F25D 23/02*** | (2006.01) |
| ***F25D 27/00*** | (2006.01) |

(52) U.S. Cl.

CPC ..... *H05B 3/84* (2013.01); *F25D 21/04* (2013.01); *F25D 23/02* (2013.01); *F25D 27/005* (2013.01); *F25D 2327/001* (2013.01); *F25D 2400/361* (2013.01); *H05B 2203/013* (2013.01)

(58) Field of Classification Search

CPC .... F21Y 2105/10; F21Y 2107/00; F21K 9/00; H05B 3/84; H05B 2203/013; F25D 21/04; F25D 23/02; F25D 27/005; F25D 2327/001; F25D 2400/361

USPC ..... 219/209, 202, 203, 522, 483; 362/612

See application file for complete search history.

(56) References Cited

U.S. PATENT DOCUMENTS

| | | | | |
|---|---|---|---|---|
| 3,379,859 | A | 4/1968 | Marriott | |
| 3,414,713 | A | 12/1968 | Reifeiss et al. | |
| 3,859,502 | A | 1/1975 | Heaney | |
| 5,083,009 | A * | 1/1992 | Reiser | H05B 3/845 219/219 |
| 5,624,591 | A | 4/1997 | Di Trapani | |
| 5,778,689 | A | 7/1998 | Beatenbough | |
| 5,959,816 | A | 9/1999 | Wood et al. | |
| 6,144,017 | A | 11/2000 | Millett et al. | |
| 6,268,594 | B1 | 7/2001 | Leutner et al. | |
| 6,476,358 | B1 * | 11/2002 | Lang | B60Q 1/2665 219/203 |
| 7,265,323 | B2 | 9/2007 | Gerhardinger et al. | |
| 7,362,491 | B2 | 4/2008 | Busick et al. | |
| 7,700,901 | B2 | 4/2010 | Busick et al. | |
| 7,728,260 | B2 * | 6/2010 | Johnson | F24D 13/026 219/200 |
| 7,905,101 | B2 | 3/2011 | Sunderland et al. | |
| 2007/0188843 | A1 | 8/2007 | Stroumbos et al. | |
| 2007/0235441 | A1 | 10/2007 | Winsler | |

(Continued)

*Primary Examiner* — Dana Ross
*Assistant Examiner* — Joseph M Baillargeon
(74) *Attorney, Agent, or Firm* — PRice Heneveld LLP

(57) ABSTRACT

A panel member for an appliance includes an outer wrapper and an inner liner that define a panel opening therethrough, a panel window disposed in the opening and having at least one glazing member that is disposed within a glazing frame, a conductive coating applied to at least one surface of the at least one glazing member and at least one electrical conductor disposed proximate a portion of the glazing frame, the electrical conductor in communication with the conductive coating.

15 Claims, 11 Drawing Sheets

(56) References Cited

U.S. PATENT DOCUMENTS

2016/0061514 A1* 3/2016 Seo ..... F21V 14/003
312/404
2017/0041987 A1* 2/2017 Weber ..... H03K 17/9622

* cited by examiner

WINDOW ASSEMBLY FOR AN APPLIANCE PANEL INCORPORATING A GLAZING MEMBER HAVING A CONDUCTIVE/RESISTIVE COATING

BACKGROUND

The device is in the field of electrical appliances having glazing members within outer appliance panels. More specifically, the device is in the field of glazing members disposed within appliance panels and incorporating a transparent conductive coating for delivering electrical power to various functions disposed within the appliance panel.

SUMMARY

In at least one aspect, a panel member for an appliance includes an outer wrapper and an inner liner that define a panel opening therethrough, a panel window disposed in the opening and having at least one glazing member that is disposed within a glazing frame. A conductive coating is applied to at least one surface of the at least one glazing member and at least one electrical conductor is disposed proximate a portion of the glazing frame. The at least one electrical conductor is in communication with the conductive coating.

In at least another aspect, a panel electrical system for a panel member of an appliance having a panel window disposed therein includes at least one glazing member that is disposed within a glazing frame and an electrical conductor disposed proximate a portion of the glazing frame. The electrical conductor is in communication with an electrical system of an appliance. At least one electrical component is disposed proximate the at least one glazing member and a conductive coating is applied to at least one surface of the at least one glazing member. The electrical conductor defines an electrical communication between the conductive coating and the at least one electrical component.

In at least another aspect, a window for an appliance panel includes first and second glazing members disposed within a glazing frame. A conductive coating is applied to a surface of one of the first and second glazing members, wherein the conductive coating is disposed within an interior space defined between the first and second glazing members. An electrical conductor is disposed proximate a portion of the glazing frame, and the electrical conductor is in communication with the conductive coating. At least one electrical component is disposed proximate the glazing frame. The conductive coating is in communication with an electrical component disposed proximate the panel window. The electrical conductor places the conductive coating in communication with the electrical component. A dynamic diode harness has at least one diode, wherein the dynamic diode harness defines a forward voltage bias state and a reverse voltage bias state. The dynamic diode harness is in communication with the electrical conductor. A selectively activated electrical component of the at least one electrical component is in communication with the dynamic diode harness, wherein the dynamic diode harness in the forward voltage bias state activates at least one selectively activated electrical component. The dynamic diode harness in the reverse voltage bias state deactivates at least one selectively activated electrical component.

These and other features, advantages, and objects of the present device will be further understood and appreciated by those skilled in the art upon studying the following specification, claims, and appended drawings.

DETAILED DESCRIPTION OF EMBODIMENTS

Figure 1:
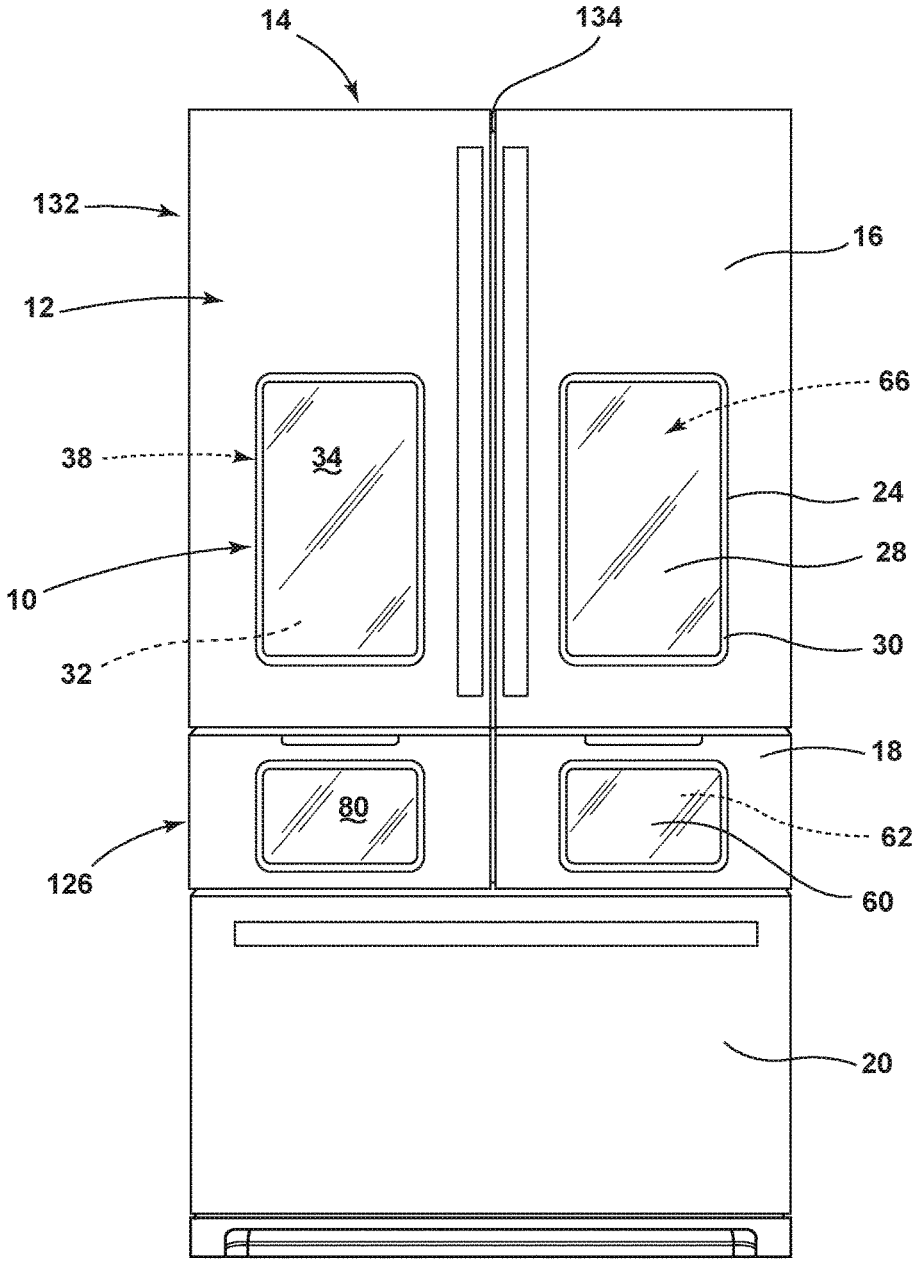
FIG. 1 is a front perspective view of a refrigerating appliance incorporating an aspect of the panel window utilizing the conductive coating upon at least one of the glazing members.
Figure 2:
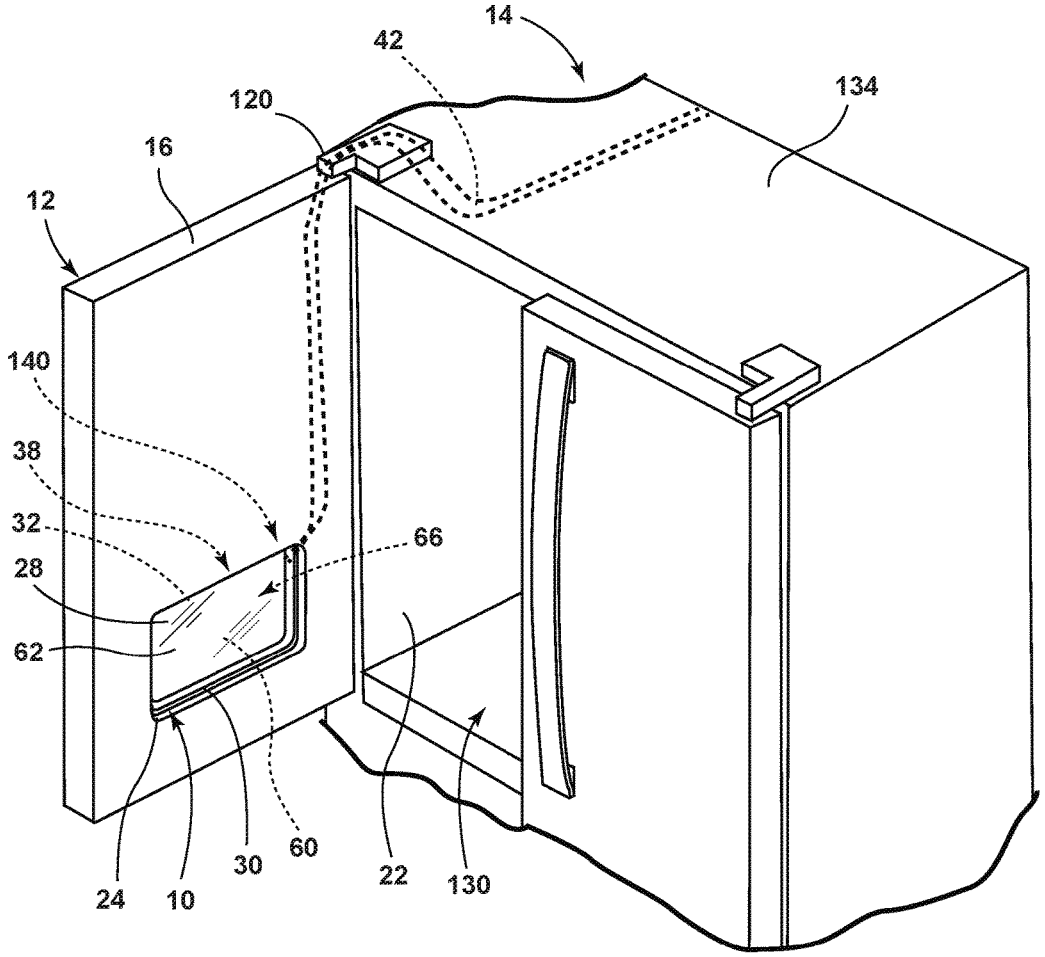
FIG. 2 is a top perspective view of an aspect of an appliance with a door in an open position and incorporating an aspect of the panel window utilizing the conductive coating in communication with an electrical system of the appliance.
Figure 3:
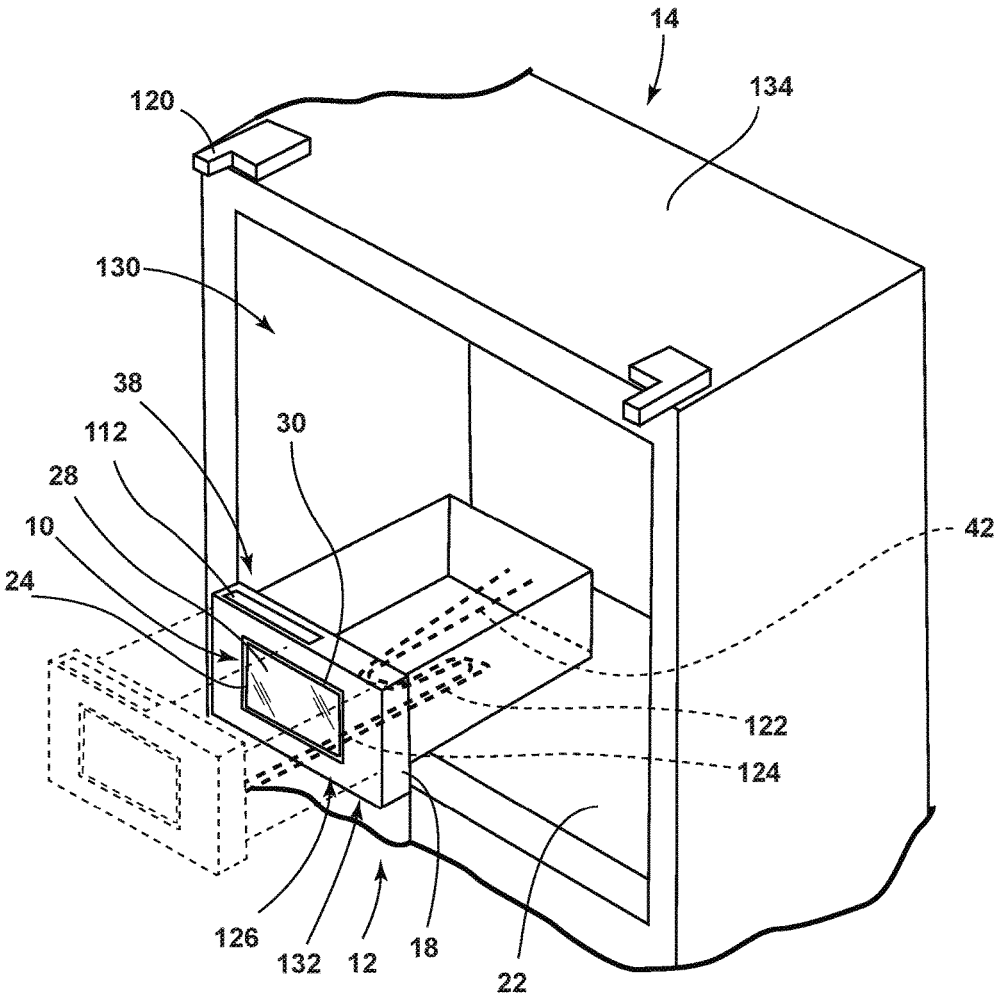
FIG. 3 is a partially exploded perspective view of an appliance incorporating an aspect of the panel window within the drawer of the appliance and illustrating an electrical system of the appliance in communication with the conductive coating applied to at least one glazing member of the panel window.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As illustrated in FIGS. 1-6, reference numeral 10 generally refers to a panel window disposed within a panel member 12 for an appliance 14, where the panel member 12 includes a door panel 16, a drawer panel 18, or other similar panel member 12 incorporated within an appliance 14. The panel member 12 for the appliance 14 includes an outer wrapper 20 and an inner liner 22 that define a panel opening 24 therethrough. A panel window 10 is disposed in the panel opening 24, where the panel window 10 includes at least one glazing member 28 that is disposed within a glazing frame 30. A conductive coating 32 is applied to at least one glazing surface 34 of the at least one glazing member 28. At least one electrical conductor 36 is disposed proximate the portion of the glazing frame 30, where the electrical conductor 36 is in communication with the conductive coating 32. It is contemplated that the conductive coating 32 is in communication with an electrical component 38 disposed proximate the panel window 10, wherein the conductive coating 32 places the at least one electrical conductor 36 in communication with the electrical component 38. In this manner, electrical current 40 from an electrical system 42 of the appliance 14 can be delivered to the various electrical conductors 36 and to the electrical component 38 via the conductive coating 32, such that minimal or no electrical wiring is positioned between the electrical conductor 36 and the electrical component 38. The electrical conductors 36 can include first and second conductors 50, 52.

Referring again to FIGS. 1-18, electrical current 40 can also be delivered through the conductive coating 32 via first and second conductors 50, 52 of the conductive coating 32 positioned proximate first and second lateral edges 54, 56 of the glazing member 28 and in communication with the conductive coating 32. In such an embodiment, electrical current 40 can be delivered to one of the first and second conductors 50, 52. The electrical current 40 can then be delivered at least partially or completely through the conductive coating 32 to the other of the first and second conductors 50, 52 to complete the circuit. In this manner, the electrical current 40 can be delivered through the panel window 10 via the first and second conductors 50, 52. Additionally, the electrical component 38 can be positioned proximate the panel window 10 to either deliver electrical current 40 to the first and second conductors 50, 52 or receive electrical current 40 from the first and second conductors 50, 52. Stated another way, the electrical system 42 of the appliance 14 can deliver electrical current 40 to the first and second conductors 50, 52, then to one or both of the conductive coating 32 and/or the electrical component 38. Alternatively, the electrical component 38 can be positioned to receive electrical current 40 from the electrical system 42, which, in turn, delivers the electrical current 40 to the first and second conductors 50, 52. The path of the electrical current 40 can be used to control the various electrical components 38, as will be described more fully below.

Referring again to FIGS. 4-6, it is contemplated that the at least one glazing member 28 of the panel window 10 can include first and second glazing members 60, 62 that are separated by a spacing structure 64. In such an embodiment, it is contemplated that the first and second conductors 50, 52 can be disposed proximate the spacing structure 64 that separates the first and second glazing members 60, 62. Accordingly, the first and second glazing members 60, 62 and the spacing structure 64 can define an interior space 66 of the panel window 10. It is contemplated that the conductive coating 32 is disposed on an interior surface 68 or multiple interior surfaces 68, that at least partially define the interior space 66 such that the conductive coating 32 is contained within the interior space 66 and substantially inaccessible by a user. Accordingly, the conductive coating 32 is substantially protected from damage by scratching, touching, deformation, or other harm that may affect the conductive and resistive functionality of the conductive coating 32. It is contemplated that the conductive coating 32 can be placed on one of the glazing members 28 at an exterior surface 80 so that it is accessible to a user. Such configurations may be implemented where the conductive coating 32 is part of a touchscreen user interface 112, such as a capacitive or resistive touchscreen.

Figure 6:
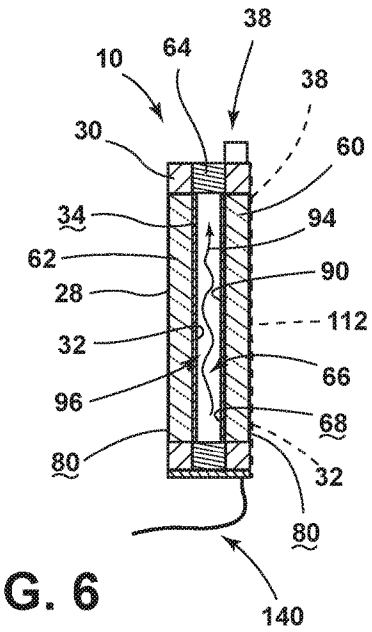
FIG. 6 is a cross-sectional view of the panel window of FIG. 4 taken along line VI-VI.
Figure 4:
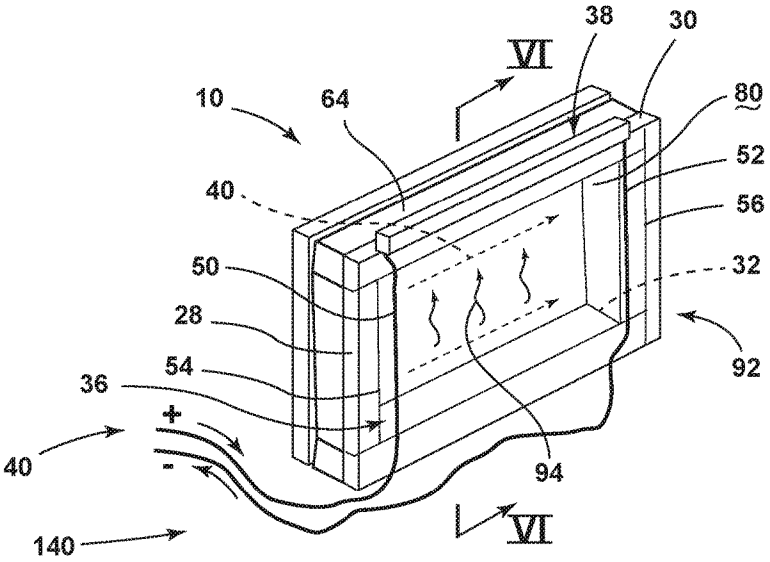
FIG. 4 is a top perspective view of an aspect of the panel window incorporating the conductive coating and schematically illustrating the electrical system of the appliance incorporated with the conductive coating.
Figure 5:
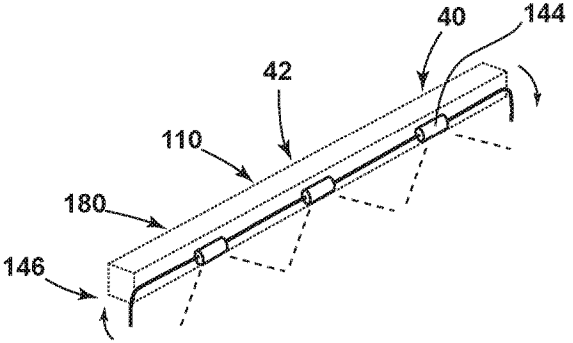
FIG. 5 is a schematic perspective view of an aspect of the electrical components of the panel window incorporating at least one lighting fixture.

Referring now to FIGS. 4-6, it is contemplated that the conductive coating 32 can also be an electrically resistive coating 90. By way of example, and not limitation, when an electrical current 40 is delivered from the electrical system 42 to the conductive coating 32 that operates as the electrically resistive coating 90, typically via the first and second conductors 50, 52, the conductive coating 32 can define a defogging condition 92. In such an embodiment, the electrically resistive coating 90 generates heat 94 as a result of the electrical resistance caused by the electrical current 40 passing through the electrically resistive coating 90. Accordingly, condensation 96, such as fluid, frost, ice, or other similar material, that may be present on the at least one glazing member 28 can be at least partially evaporated by the heat 94 generated by the conductive coating 32 in the defogging condition 92.

Figure 8:
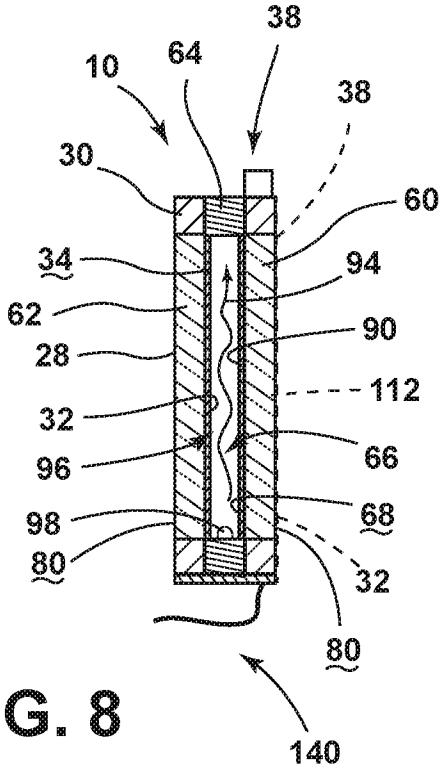
FIG. 8 is a cross-sectional view of the panel window of FIG. 7 taken along line VIII-VIII.
Figure 7:
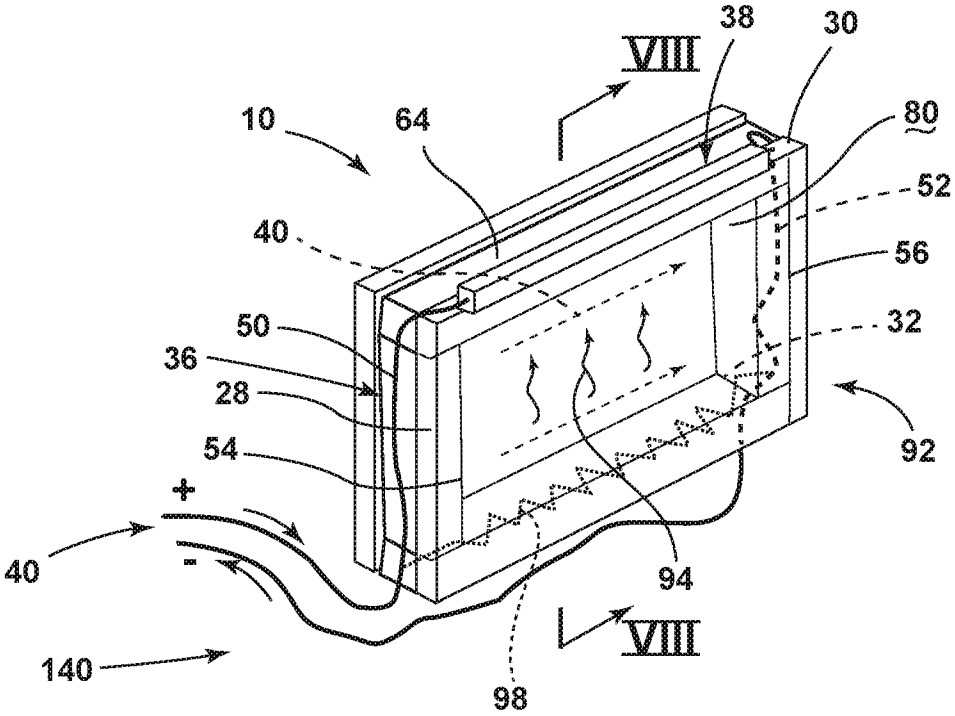
FIG. 7 is a top perspective view of an aspect of the panel window incorporating a conductive coating and schematically illustrating an aspect of the electrical system for the panel window.

Referring now to FIGS. 7 and 8, it is contemplated that where additional heat 94 is needed to evaporate condensation 96 that may be present on the at least one glazing member 28, an additional wire heating element 98 can be disposed within a portion of the panel window 10 such that the wire heating element 98 is connected with the first and second conductors 50, 52. In this manner, the wire heating element 98 can be positioned within the glazing frame 30, the spacing structure 64, or another area proximate the interior space 66 of the panel window 10. Accordingly, various levels of heat 94 can be delivered throughout the interior space 66 for removing condensation 96 present on at least one glazing member 28. It is contemplated that heat 94 provided by the conductive coating 32 in the defogging condition 92 and/or the wire heating element 98 can operate individually or in combination to elevate the temperature of the interior space 66 within the panel window 10 to evaporate condensation 96 that may be present on the interior surface 68 that at least partially defines the interior space 66. Because the conductive coating 32 elevates the temperature of the entire interior space 66, a conductive coating 32 disposed on the first glazing member 60, and/or the wire heating element 98, may serve to elevate the temperature of the interior space 66 to remove condensation 96 that may be present on an interior surface 68 of the second glazing member 62 and/or a third glazing member 100 of the panel window 10.

Figure 10:
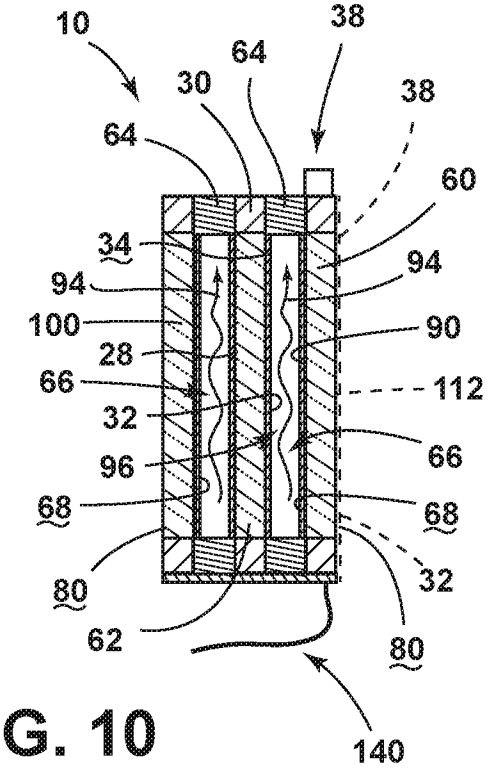
FIG. 10 is a cross-sectional view of the panel window of FIG. 9 taken along line X-X.
Figure 9:
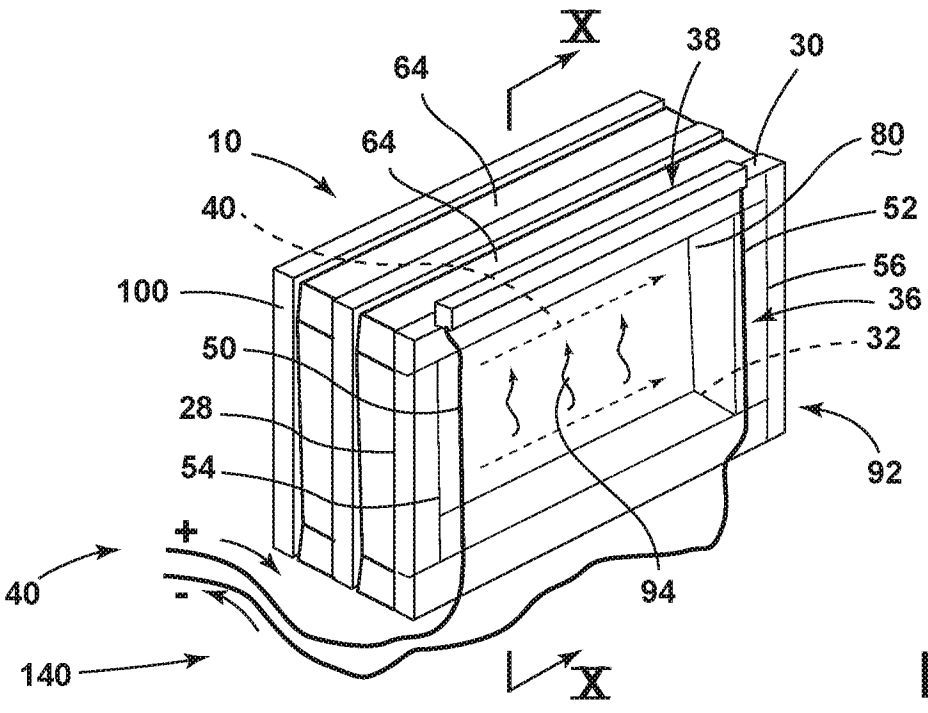
FIG. 9 is a top perspective view of an aspect of the panel window incorporating the conductive coating on at least one glazing member and schematically illustrating an electrical system incorporated within the panel window.

Referring now to FIGS. 9 and 10, it is contemplated that the panel window 10 can include three or more individual glazing members 28 that define at least two interior spaces 66 defined therebetween. In such an embodiment, it is contemplated that one or more interior surfaces 68 defined by the various glazing members 28 can include the conductive coating 32. Each of the layers of conductive coating 32 applied to the various glazing members 28 can provide individual heating and/or electricity delivery functions as each of the layers of the conductive coating 32 can also define the electrically resistive coating 90. Accordingly, each layer of conductive coating 32 on the various glazing members 28 can serve to heat a respective interior space 66 for removing condensation 96 that may appear within the respective interior space 66 on an interior surface 68 of the respective interior space 66. It is also contemplated that each conductive coating 32 can have a different functionality. In such an embodiment, one layer of conductive coating 32 may have a greater resistive property to be used primarily as the electrically resistive coating 90 to define the defogging condition 92 in a particular location of the panel window 10. As discussed above, the heat 94 generated by one electrically resistive coating 90 may be sufficient to operate the defogging condition 92 and evaporate condensation 96 throughout the panel window 10. Accordingly, a single layer of electrically resistive coating 90 can generate enough heat 94 to evaporate condensation 96 in multiple interior spaces 66. Alternatively, a separate layer of the conductive coating 32 may provide a more conductive functionality for delivering electrical current 40 from the electrical system 42 of the appliance 14 and/or the electrical conductor 36 to a separate electrical component 38, such as a lighting element 110, user interface 112, air handling unit, compartment heater, or other similar electrical component 38 that may be disposed within the panel member 12 proximate the panel window 10. These layers of the electrically resistive coating 90 can also operate via the first and second conductors 50, 52. In such an embodiment, each layer of conductive coating 32 can be in communication with a set of corresponding first and second conductors 50, 52. Each layer of the conductive coating 32 can include respective first and second conductors 50, 52 that deliver electrical current 40 through the conductive coating 32 and from the first conductor 50 to the second conductor 52 and vice versa.

Referring again to FIGS. 2 and 3, it is contemplated that the use of the conductive coating 32 within the panel window 10 of the various panel members 12 of the appliance 14 can serve to limit the amount of wiring necessary to be run to each of the electrical components 38 disposed within the panel member 12 of the appliance 14. Accordingly, wiring from the electrical system 42 to the appliance 14 can be run through a door hinge 120 (as exemplified in FIG. 2), or through a drawer conduit 122, a drawer glide, slide harness 124, or other portion of a drawer 126 of the appliance 14 (as exemplified in FIG. 3), and to a respective electrical conductor 36 disposed proximate the panel window 10 defined within the panel member 12. In this manner, electrical wiring may be run to the first and second conductors 50, 52 which, in turn, delivers the electrical current 40 to the conductive coating 32, for delivery to an electrically resistive coating 90 to define the defogging condition 92, or to one or more other electrical components 38 disposed within the panel member 12 of the appliance 14. This use of a conductive coating 32 can serve to limit the amount of wiring needed to be run from the first and second conductors 50, 52 to the various electrical components 38 disposed within the panel member 12, while also allowing for the panel window 10 to be disposed within the panel member 12 for viewing of an interior compartment 130 of the appliance 14 when the panel member 12 is in a closed position 132 relative to a cabinet 134 of the appliance 14.

Referring now to FIGS. 11-18, it is contemplated that the electrical conductor 36, the conductive coating 32, and the various electrical components 38 disposed within the panel member 12 can define a panel electrical system 140 disposed within the panel member 12 of the appliance 14. It is contemplated that the panel electrical system 140 can include a dynamic diode harness 142 having at least one diode 144, wherein the dynamic diode harness 142 defines a forward voltage bias state 146 and a reverse voltage bias state 148. The dynamic diode harness 142 can be in communication with one or both of the electrical conductor 36 and the conductive coating 32.

According to the various embodiments, as exemplified in FIGS. 11-18, it is contemplated that at least one selectively activated electrical component 150 of the various electrical components 38 disposed within the panel member 12 of the appliance 14 can also be placed in communication with the electrical conductor 36 and/or the dynamic diode harness 142. In such an embodiment, the dynamic diode harness 142 in the forward voltage bias state 146 activates the at least one selectively activated electrical component 150. When the dynamic diode harness 142 is in the reverse voltage bias state 148, the selectively activated electrical component 150 can be deactivated. The selectively activated electrical component 150 can be one of a lighting fixture, the electrically resistive coating 90, the user interface 112, and other similar electrical components 38 as described herein.

According to the various embodiments, as exemplified in FIGS. 4-18, the forward voltage bias state 146 can be defined by electrical current 40 running from the electrical system 42 to the first conductor 50 and from the first conductor 50 to a first end 152 of the dynamic diode harness 142 and also to the conductive coating 32. The electrical current 40 is then run through the dynamic diode harness 142 and the conductive coating 32 and then to the second conductor 52 to complete the circuit with the electrical system 42. The reverse voltage bias state 148 is defined by the electrical current 40 being run from the electrical system 42 to the second conductor 52 and then to the conductive coating 32 and the second end 154 of the dynamic diode harness 142. However, the dynamic diode harness 142 is configured to only allow electrical current 40 to pass through when the electrical current 40 comes from the first conductor 50 in the forward voltage bias state 146. Depending on the position of the dynamic diode harness 142, as will be described more fully below, electrical current 40 may be permitted to pass from the second conductor 52, through the conductive coating 32 and to the first conductor 50. Accordingly, the forward and reverse voltage bias states 146, 148 can be used to activate and deactivate an electrical component 38 through the use of the dynamic diode harness 142.

According to the various embodiments, as exemplified in FIGS. 11-18, the dynamic diode harness 142 can include at least one diode 144 that is configured to conduct electrical current 40 in one direction. In this manner, the dynamic diode harness 142 in defining the forward voltage bias state 146 permits electrical current 40 to pass through the one or more diodes 144 of the dynamic diode harness 142 and run to the selectively activated electrical component 150. Conversely, when a reverse voltage bias is present, such as electrical current 40 entering via the second conductor 52, the dynamic diode harness 142 defines the reverse voltage bias state 148. In this state, electrical current 40 is not permitted to pass through the one or more diodes 144 of the dynamic diode harness 142, such that no electrical current 40 is delivered to the selectively activated electrical component 150. In this manner, depending upon the electrical bias provided through engagement of the first and second conductors 50, 52 with the dynamic diode harness 142, the various electrical components 38 of the panel member 12 can be activated and deactivated depending upon the needs of the user. Additionally, the location of the dynamic diode harness 142 can serve to separate the selectively activated electrical components 150 from those electrical components 38 that may need to be continually activated in both the forward and reverse voltage bias states 146, 148.

By way of example, and not limitation, the dynamic diode harness 142 may be placed within the panel window 10 such that the electrical conductor 36, such as the first and second conductors 50, 52, are in communication with the conductive coating 32 and the electrical components 38 and/or a selectively activated electrical component 150, as exemplified in FIGS. 15-18. In such an embodiment, the conductive coating 32 directly engages the electrical conductor 36 and can serve as the electrically resistive coating 90 that may be activated regardless of whether electrical current 40 is delivered from the first or second conductor 50, 52 and to the conductive coating 32. In this manner, the defogging condition 92 can be activated whenever electrical current 40 is delivered from the electrical system 42 and travels through the first or second conductor 50, 52 and to the conductive coating 32. Conversely, electrical current 40 that reaches the dynamic diode harness 142 from the first or second conductors 50, 52 defines either the forward or reverse voltage bias states 146, 148 to activate or deactivate, respectively, an electrical component 38. Accordingly, the dynamic diode harness 142 can serve to activate or deactivate the selectively activated electrical component 150 while leaving the defogging condition 92 activated during both the forward and reverse voltage bias states 146, 148 by delivering electrical current 40 to the dynamic diode harness 142 from either the first or second conductor 50, 52, respectively.

Figure 12:
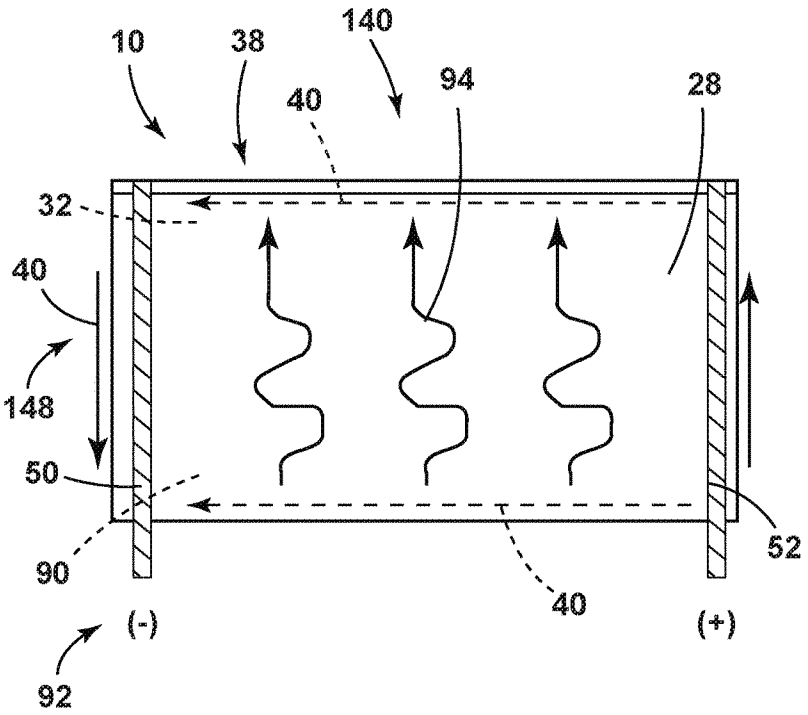
FIG. 12 is a schematic elevational view of the panel window of FIG. 11 illustrating a reverse voltage bias state.
Figure 11:
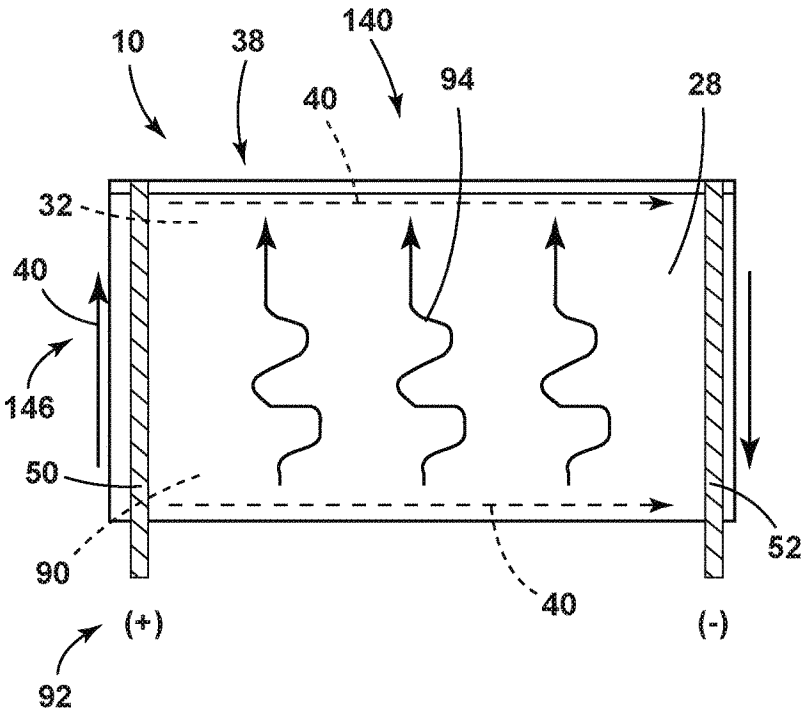
FIG. 11 is a schematic elevational view of a panel member illustrating an aspect of the electrical components of the panel window and illustrating a forward voltage bias state.

Referring to the embodiments exemplified in FIGS. 11 and 12, the panel window 10 can be configured to be free of a dynamic diode harness 142 such that whenever electrical current 40 is applied from the electrical system 42 to the conductive coating 32 via either of the first or second conductors 50, 52, the defogging condition 92 is activated, such that the conductive coating 32, serving as the electrically resistive coating 90, defines the defogging condition 92. It is contemplated that in this embodiment, being free of a dynamic diode harness 142, a separate electrical component 38 can also be activated along with the electrically resistive coating 90, where such electrical component 38 can include, but is not limited to, a lighting element 110, a user interface 112, air handler, heater, or other similar electrical component 38.

Figure 14:
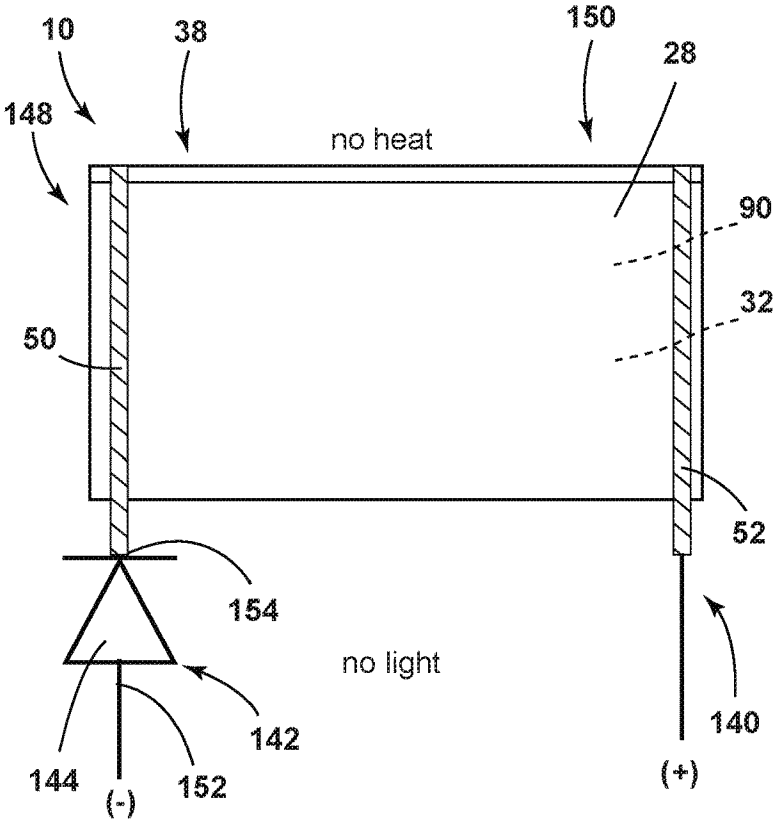
FIG. 14 is a schematic front elevational view of the panel window of FIG. 13 illustrating a reverse voltage bias state.
Figure 13:
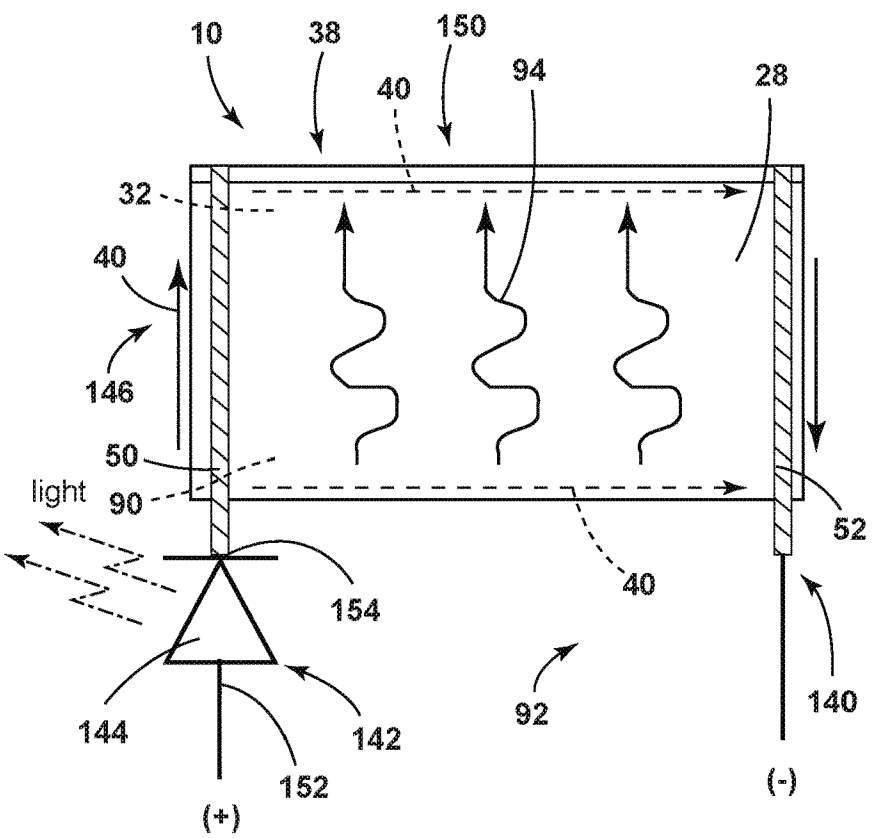
FIG. 13 is a schematic front elevational view of an aspect of the panel window and illustrating the electrical components of the panel window in a forward voltage bias state.

Referring now to the embodiments exemplified in FIGS. 13 and 14, it is contemplated that a diode 144 and/or the dynamic diode harness 142 can be engaged with a portion of the electrical conductor 36, such as one of the first and second conductors 50, 52. In such an embodiment, all of the electrical components 38 disposed within the panel window 10 can be activated and deactivated depending upon whether the diode 144 and/or the dynamic diode harness 142 is in the forward or reverse voltage bias states 146, 148. The dynamic diode harness 142, or a single diode 144, can be disposed between the electrical system 42 and at least one of the first and second conductors 50, 52. Accordingly, the circuit can only be completed when the electrical current 40 is run to define the forward voltage bias state 146. When in the forward voltage bias state 146, it is contemplated that the electrically resistive coating 90 and a separate electrical component 38, such as a lighting element 110 can be activated simultaneously, these electrical components 38 can also be deactivated simultaneously when the dynamic diode harness 142 is placed in the reverse voltage bias state 148.

Figure 16:
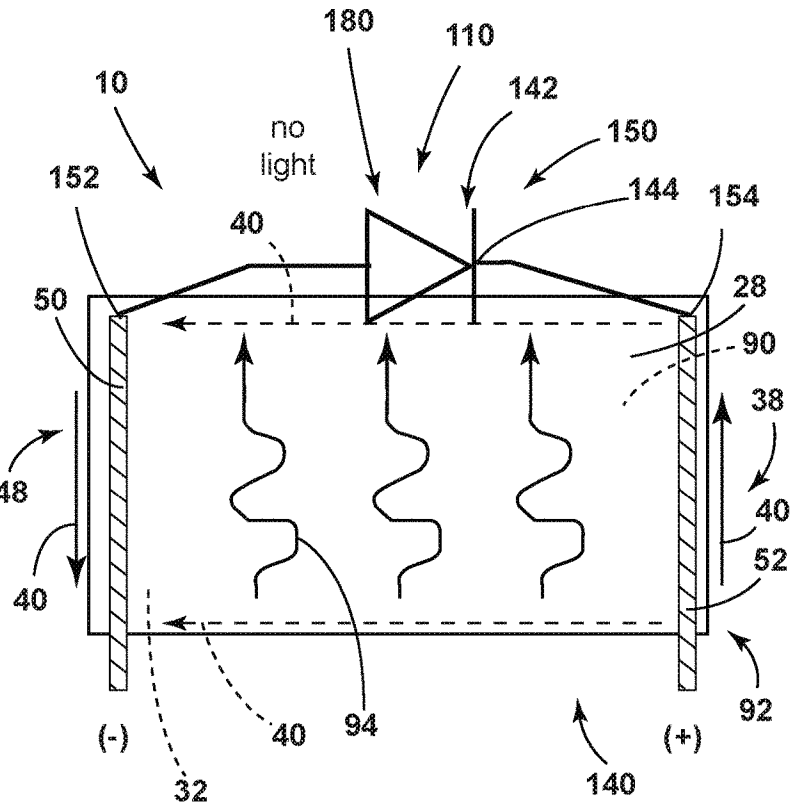
FIG. 16 is a schematic elevational view of the panel window of FIG. 15 illustrating a reverse voltage bias state.
Figure 15:
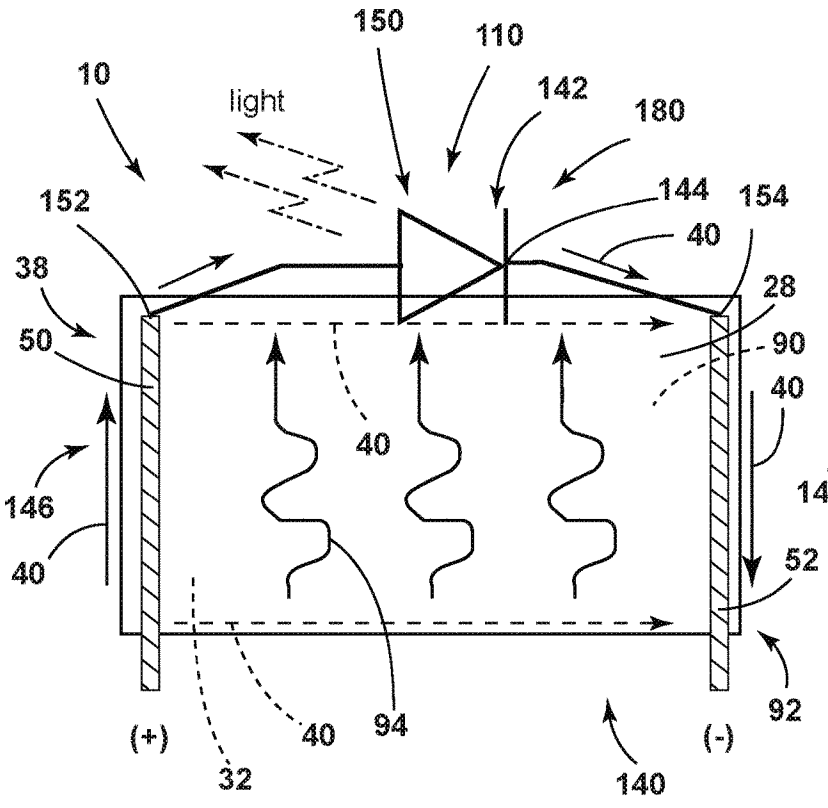
FIG. 15 is a schematic elevational view of an aspect of a panel window illustrating the electrical components of the panel window and illustrating a forward voltage bias state.

Referring now to the various embodiments exemplified in FIGS. 15 and 16, it is contemplated that the dynamic diode harness 142 can be disposed such that the conductive coating 32 can continually serve as the electrically resistive coating 90 whenever electrical current 40 is provided by the electrical conductor 36 to the conductive coating 32 via the first and second conductors 50, 52. The location of the dynamic diode harness 142 can be at an opposite side of the panel window 10 from where the electrical conductor 36 engages the conductive coating 32. This configuration allows the dynamic diode harness 142 to separately activate and deactivate the selectively activated electrical component 150. This configuration also results from the first and second conductors 50, 52 of the electrical conductors 36 running from the electrical system 14 to the dynamic diode harness 142. Electrical current 40 is permitted to continually run between the first and second conductors 50, 52 and through the conductive coating 32. Conversely, the dynamic diode harness 142 activates and deactivates the selectively activated electrical component 150 depending on whether current arrives via the first or second conductor 50, 52.

According to the various embodiments, it is contemplated that the selectively activated electrical component 150 can be any one or more of a lighting element 110, the user interface 112, an air handling unit, a compartment heater, mullion heater or other similar electrical component 38. As discussed above, when either the forward or reverse voltage bias is applied to the conductive coating 32 via the first or second conductor 50, 52, the conductive coating 32 serves as the electrically resistive coating 90 to define the defogging condition 92. Simultaneously, as the electrical current 40 passes through the first and second conductors 50, 52 and reaches the dynamic diode harness 142, the dynamic diode harness 142 can define either the forward or reverse voltage bias state 146, 148 to activate or deactivate, respectively, the selectively activated electrical component 150. Accordingly, a user interface 112 of the appliance 14 or of the panel member 12, can serve to change the flow of electrical current 40 to arrive from either the first or second conductor 50, 52 to alternate the state of the dynamic diode harness 142 from between the forward voltage bias state 146 to the reverse voltage bias state 148 to activate and deactivate the selectively activated electrical component 150.

According to the various embodiments, the first and second conductors 50, 52 can be separate conductive members that are run along opposite sides of the glazing member 28 having a layer of these conductive coatings 32. It is also contemplated that the first and second conductors 50, 52 can be defined by portions of the conductive coating 32 that allow the electrical current 40 to run from the electrical system 42 and through the first conductor 50, through a separate portion of the conductive coating 32 or a linking conductor, such as an electrical conductor 36, a dynamic diode harness 142, or other conductor, and to the second conductor 52, or vice versa. Such a configuration can further serve to limit the amount of wiring present within the panel member 12 and around the panel window 10.

According to the various embodiments, each selectively activated electrical component 150, such as a lighting element 110, the wire heating element 98, or other electrical component 38 can include a dedicated diode 144 to allow the forward and reverse voltage bias states 146, 148 to activate and deactivate the respective electrical components 38. It is also contemplated that the panel electrical system 140 can include electrically opposing dynamic diode harnesses 142. In such an embodiment, the opposing dynamic diode harnesses 142 can be oppositely configured such that when one of the dynamic diode harnesses 142 is in the forward voltage bias state 146, the other dynamic diode harness 142 is in the reverse voltage bias state 148. Accordingly, various selectively activated electrical components 150 can be connected with respective dynamic diode harnesses 142 of the opposing dynamic diode harnesses 142 such that the selectively activated electrical components 150 can be alternatively and selectively activated/deactivated. Such a configuration may be implemented where a fan and heating element for the drawer 126 can be alternatively activated and deactivated for precise climate control. Other uses of the opposing dynamic diode harnesses 142 can be contemplated as well.

Figure 17:
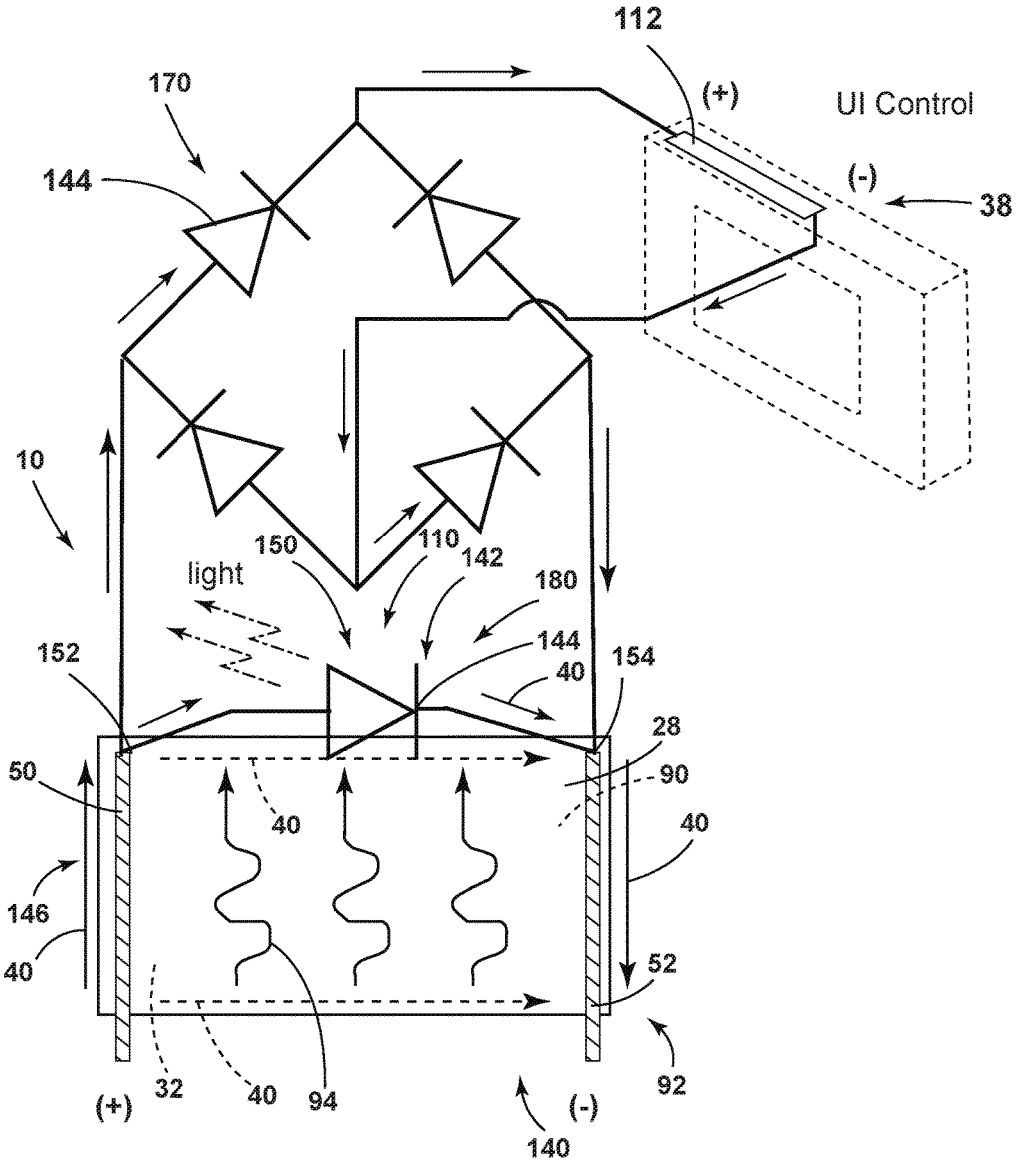
FIG. 17 is a schematic illustration of the electrical components of a panel window incorporating a diode bridge in communication with a user interface proximate the panel window and illustrating a forward voltage bias state.
Figure 18:
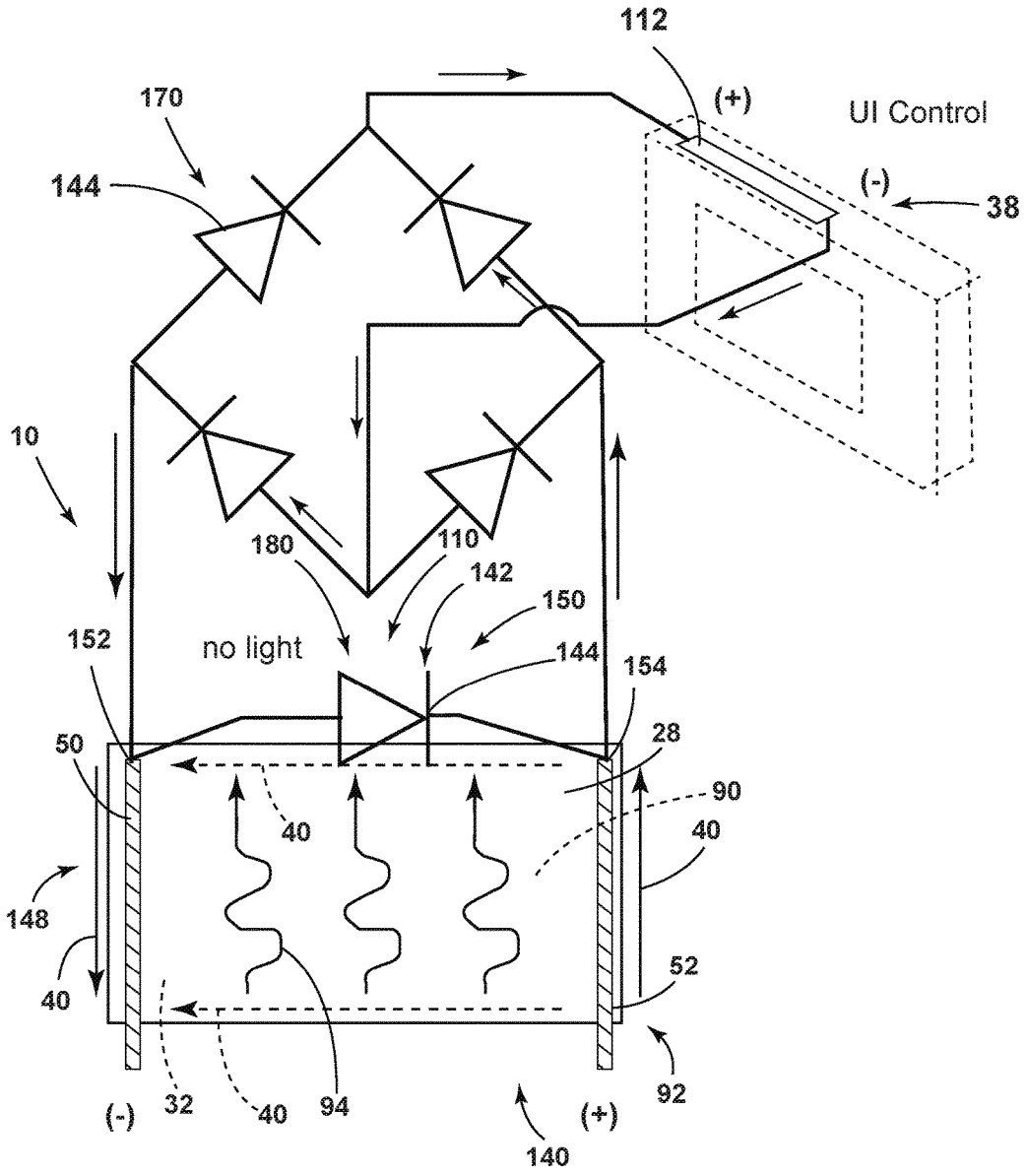
FIG. 18 is a schematic illustration of the panel window of FIG. 17 illustrating the reverse voltage bias state.

Referring now to the various embodiments exemplified in FIGS. 17 and 18, it is contemplated that the panel electrical system 140 can include a user interface 112 in communication with the utility system of the appliance 14. In this manner, the user interface 112 disposed within a portion of a panel member 12 can be placed in communication with the various systems of the appliance 14 that can include, but are not limited to, the refrigeration system, the electrical system 42, the data communications system, a wireless network of the appliance 14, a monitoring system of the appliance 14, and other similar utility systems of the appliance 14. In such an embodiment, a diode bridge 170 made up of a plurality of diodes 144 can be coupled to the user interface 112 and the dynamic diode harness 142. It is contemplated that the user interface 112 is configured to receive electrical current 40 from the first and second conductors 50, 52 via the diode bridge 170. It is also contemplated that electrical current can be delivered to the user interface 112 from a first end 152 or a second end 154 of the dynamic diode harness 142 via the diode bridge 170. The diode bridge 170 is configured to deliver the electrical current 40 in a non-switching polarity, such that the user interface 112 always receives the same voltage bias and is activated in both the forward voltage bias state 146 and the reverse voltage bias state 148.

By way of example, and not limitation, wiring for the electrical system 42 can be run to a base of the panel window 10 to deliver electrical current 40 to the first and second conductors 50, 52 and the conductive coating 32, where the conductive coating 32 can define the electrically resistive coating 90 that serves to define the defogging condition 92 of the panel window 10. The electrical current 40 is then delivered through the first and second conductors 50, 52 to the one of the first and second ends 152, 154 of the dynamic diode harness 142 in the form of a forward or reverse voltage bias to define the forward and reverse voltage bias states 146, 148 of the dynamic diode harness 142. In the reverse voltage bias state 148, the diode bridge 170 can be coupled to the second conductor 52 and/or the second end 154 of the dynamic diode harness 142 such that electrical current 40, while not permitted to pass through the dynamic diode harness 142, is permitted to pass through the diode bridge 170 and onto the user interface 112 of the panel member 12 in a particular orientation. Similarly, in the forward voltage bias state 146 of the dynamic diode harness 142, electrical current 40 is allowed to pass through the dynamic diode harness 142 to activate the selectively activated electrical component 150. Electrical current 40 is allowed to pass through the diode bridge 170 to maintain the user interface 112 in an active state by delivering electrical current 40 in a non-switching polarity and to the user interface 112 in the same orientation. In this manner, this selectively activated electrical component 150, such as a lighting element 110, can be activated and deactivated while the user interface 112 and the electrically conductive coating 32 can be maintained in an activated state so long as electrical current 40 passes from the electrical system 42 to the conductive coating 32.

According to the various embodiments, the dynamic diode bridge 170 can include a lighting element 110, such as a light emitting diode (LED) or other similar lighting element 110 that is activated and deactivated by the dynamic diode harness 142.

According to the various embodiments, it is contemplated that the panel window 10 can include two or more separate layers of the conductive coating 32 that can provide different functionalities to the panel window 10. By way of example, and not limitation, it is contemplated that a first layer of the conductive coating 32 can serve as the electrically resistive coating 90. In such an embodiment, the dynamic diode harness 142 may or may not be present proximate the first layer of the conductive coating 32. Additionally, the panel window 10 can include a second layer of the conductive coating 32 that is disposed on a separate interior surface 68 of the various glazing members 28 of the panel window 10, where the second layer of conductive coating 32 can include a dynamic diode harness 142 and/or a diode bridge 170 for operating the user interface 112 and also the selectively activated electrical component 150 of the panel member 12 of the appliance 14. In this manner, the first and second layers of the conductive coating 32 can be selectively activated and deactivated to operate the various electrical components 38 disposed within the panel member 12 of the appliance 14.

Referring again to FIGS. 5, 13 and 14, the dynamic diode harness 142 disposed relative to the electrical conductor 36 can serve to define circuitry where the dynamic diode harness 142 delivers a direct current (DC) power to the conductive coating 32 and also to an LED array 180 located near the panel window 10. In such an embodiment, the forward voltage bias state 146 of the dynamic diode harness 142 powers both the conductive coating 32 in the form of the electrically resistive coating 90 and also activates the LED array 180 simultaneously. The reverse voltage bias state 148 of the dynamic diode harness 142, in this circuit configuration, serves to deactivate both the electrically resistive coating 90 and the LED array 180.

Referring now to FIGS. 15 and 16, where the dynamic diode harness 142 is disposed relative to the electrical conductor 36 to define circuitry such that the conductive coating 32 can define the defogging condition 92 independent of whether the dynamic diode bridge 170 defines the forward or reverse voltage bias states 146, 148. In this circuit configuration, the dynamic diode harness 142 activates and deactivates the selectively activated electrical component 150 depending on whether the dynamic diode harness 142 defines a forward or reverse voltage bias state 146, 148, respectively.

According to the various embodiments, the conductive coating 32 can be made of various transparent or partially transparent coating materials. Such coatings can include, but are not limited to, tin oxide, indium tin oxide, graphene, fluorine doped tin oxide, doped zinc oxide, other conductive oxides, nano wires, ultra-thin metal films, combinations thereof and other similar transparent or partially transparent conductive coatings 32.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A panel member for an appliance, the panel member comprising:

an outer wrapper and an inner liner that define a panel opening therethrough, wherein a hinge is coupled to the outer wrapper for rotational operation of said panel member;

a panel window disposed in the panel opening and having at least one glazing member that is disposed within a glazing frame;

a single continuous conductive coating applied to at least one surface of the at least one glazing member;

at least one electrical conductor disposed in engagement with a portion of the glazing frame, the at least one electrical conductor in communication with the conductive coating, wherein electrical wiring is delivered to the at least one electrical conductor via the hinge;

a dynamic diode harness having at least one diode, wherein the dynamic diode harness defines a forward voltage bias state and a reverse voltage bias state, wherein the dynamic diode harness is in communication with the at least one electrical conductor and the conductive coating; and at least one selectively activated electrical component in communication with the dynamic diode harness, wherein the dynamic diode harness in the forward voltage bias state activates the at least one selectively activated electrical component, and wherein the dynamic diode harness in the reverse voltage bias state deactivates at least one selectively activated electrical component, wherein:

the conductive coating is an electrically resistive coating;

when an electrical current is delivered from the at least one electrical conductor to the conductive coating, the conductive coating defines a defogging condition and condensation present on the at least one glazing member is at least partially evaporated by the conductive coating in the defogging condition;

the at least one electrical conductor includes first and second conductors, and wherein the first and second conductors are connected with the conductive coating and the dynamic diode harness, and wherein the defogging condition is activated in both the forward voltage bias state and the reverse voltage bias state.

2. The panel member of claim 1, wherein the conductive coating is in communication with an electrical component disposed adjacent to the panel window, wherein the conductive coating places the at least one electrical conductor in communication with the electrical component.

3. The panel member of claim 2, wherein the electrical component includes at least one of a lighting element and a user interface and wherein the conductive coating includes first and second conductors.

4. The panel member of claim 1, wherein the at least one glazing member includes first and second glazing members that are separated by a spacing structure, and wherein the at least one electrical conductor is disposed adjacent to the spacing structure.

5. The panel member of claim 4, wherein the first and second glazing members and the spacing structure define an interior space of the panel window, wherein the conductive coating is disposed on an interior surface that at least partially defines the interior space.

6. The panel member of claim 1, wherein the at least one selectively activated electrical component includes a lighting fixture.

7. The panel member of claim 1, wherein a diode is in communication with the at least one electrical conductor, and wherein the defogging condition is activated in the forward voltage bias state, and wherein the defogging condition is deactivated in the reverse voltage bias state.

8. The panel member of claim 1, further comprising:

a user interface in communication with a utility system of the appliance; and a diode bridge coupled to the user interface and the first and second conductors, wherein the user interface receives electrical current from at least one of the first and second conductors via the diode bridge, wherein the diode bridge delivers the electrical current in a non-switching polarity such that the user interface is activated in both the forward voltage bias state and a reverse voltage bias state.

9. A panel electrical system for a panel member of an appliance having a panel window disposed therein, the panel electrical system comprising:

at least one glazing member that is disposed within a glazing frame;

an electrical conductor in engagement with a portion of the glazing frame, the electrical conductor in communication with an electrical system of the appliance, wherein the electrical conductor is coupled to the electrical system of said appliance via at least one of a drawer glide and a door hinge;

at least one electrical component disposed at least near the at least one glazing member;

a single and continuous conductive coating applied to at least one surface of the at least one glazing member, wherein the electrical conductor defines an electrical communication between the conductive coating and the at least one electrical component;

a dynamic diode harness having at least one diode, wherein the dynamic diode harness defines a forward voltage bias state and a reverse voltage bias state, wherein the dynamic diode harness is in communication with at least one of the electrical conductor and the conductive coating; and at least one selectively activated electrical component in communication with the dynamic diode harness, wherein the dynamic diode harness in the forward voltage bias state activates at least one selectively activated electrical component, and wherein the dynamic diode harness in the reverse voltage bias state deactivates at least one selectively activated electrical component, wherein:

the conductive coating is an electrically resistive coating;

when an electrical current is delivered from the electrical conductor to the conductive coating, the conductive coating defines a defogging condition;

the dynamic diode harness is in direct engagement with at least one of the electrical conductor and the conductive coating; and the defogging condition is activated in both the forward voltage bias state and a reverse voltage bias state.

10. The panel electrical system of claim 9, wherein condensation present on the at least one glazing member is at least partially evaporated by the conductive coating in the defogging condition.

11. The panel electrical system of claim 9, wherein the at least one electrical component includes at least one of a lighting element and a user interface.

12. The panel electrical system of claim 9, wherein the at least one glazing member includes first and second glazing members that are separated by a spacing structure, and wherein the electrical conductor is disposed adjacent to the spacing structure.

13. The panel electrical system of claim 9, wherein the conductive coating is disposed between the electrical conductor and the dynamic diode harness, and wherein the defogging condition is activated in both the forward voltage bias state and a reverse voltage bias state.

14. The panel electrical system of claim 9, wherein the dynamic diode harness is in direct engagement with the electrical conductor, and wherein the defogging condition is activated in both the forward voltage bias state and a reverse voltage bias state.

15. The panel electrical system of claim 9, further comprising:

a user interface in communication with a utility system of the appliance; and a diode bridge coupled to the user interface and at least one of the dynamic diode harness and the electrical conductor, wherein the user interface receives electrical current from at least one of the dynamic diode harness and the electrical conductor via the diode bridge, wherein the diode bridge delivers the electrical current in a non-switching polarity such that the user interface is activated in both the forward voltage bias state and a reverse voltage bias state.

* * * * *